United States Patent [19]

Tsuchiya

[11] Patent Number: 5,070,366

[45] Date of Patent: Dec. 3, 1991

[54] IMAGE FORMING APPARATUS FEATURING A CONSTANT CONTACT-PRESSURE DRIVE

[75] Inventor: Yoshiro Tsuchiya, Yokohama, Japan

[73] Assignee: Canon Kabushiki Kaisha, Tokyo, Japan

[21] Appl. No.: 491,154

[22] Filed: Mar. 9, 1990

[30] Foreign Application Priority Data

Mar. 10, 1989 [JP] Japan ..... 1-59038

[51] Int. Cl.[5] ..... G03G 15/02

[52] U.S. Cl. ..... 355/219; 74/63; 74/68; 355/282; 355/295; 355/296

[58] Field of Search ..... 355/277, 271, 282, 296, 355/219, 295, 290, 301; 74/63, 68; 464/69, 81, 904, 149

[56] References Cited

U.S. PATENT DOCUMENTS

| | | | |
|---|---|---|---|
| 2,807,233 | 9/1957 | Fitch | 355/271 X |
| 3,063,264 | 12/1962 | Forrest | 464/904 X |
| 3,221,566 | 12/1965 | Gelardi | 74/68 |
| 3,258,988 | 7/1966 | Schmidt | 74/68 |
| 3,827,800 | 8/1974 | Tanaka et al. | 355/271 X |
| 4,257,700 | 3/1981 | Tsuda et al. | 355/271 X |
| 4,309,803 | 1/1982 | Blaszak | 355/219 |
| 4,600,929 | 7/1986 | Cardona et al. | 355/277 X |
| 4,739,370 | 4/1988 | Yoshida et al. | 355/296 |

FOREIGN PATENT DOCUMENTS

| | | | |
|---|---|---|---|
| 0032334 | 3/1977 | Japan | 355/301 |
| 0164372 | 12/1981 | Japan | 355/277 |
| 0172677 | 10/1983 | Japan | 355/301 |

*Primary Examiner*—A. T. Grimley
*Assistant Examiner*—Sandra L. Hoffman
*Attorney, Agent, or Firm*—Fitzpatrick, Cella, Harper & Scinto

[57] ABSTRACT

An image forming apparatus including an image bearing member and a rotatable member such as a transfer roller, a charging roller or a cleaning roller press-contacted to the image bearing member in relation to an image formation process on the image bearing member. A coupling is employed for transmitting the driving force from a driving power source to the rotatable member, so that the state of press-contact between the image bearing member and the rotatable member is maintained substantially uniform along the longitudinal direction with stability.

44 Claims, 4 Drawing Sheets

IMAGE FORMING APPARATUS FEATURING A CONSTANT CONTACT-PRESSURE DRIVE

FIELD OF THE INVENTION AND RELATED ART

The present invention relates to an image forming apparatus such as a copying machine or printer using an electrophotographic, electrostatic recording, magnetic recording or the like.

The present invention is particularly suitable for an image forming apparatus including a roller which is driven while being press-contacted to an image bearing member and which functions as an image forming process means.

Here, the image bearing member may be an electrophotographic photosensitive member, an electrostatic recording dielectric member, a magnetic recording magnetic member or the like in the form of a rotatable drum, a rotatable belt, a traveling web or the like.

Such a roller is one of the following, for example:

(1) An image transfer roller which is rotationally driven in the same peripheral direction as and substantially at the same peripheral direction as the peripheral movement of the image bearing member and which press-contacts to.the surface of the image bearing member the transfer material introduced between the image bearing member and itself to sequentially transfer to the surface of the transfer material a visualized image (toner image) formed and carried on the image bearing member.

(2) A cleaning roller which is rotationally driven to rub the surface of the image bearing member after the image transfer to remove deposited contamination such as residual toner from the surface of the image bearing member to clean it for repeated use thereof.

(3) A contact type charging roller which is rotationally driven in the same peripheral direction and substantially at the same speed as the surface speed of the image bearing member, or rotationally driven to rub the surface of the image bearing member to uniformly and electrically charging the surface of the image bearing member to a positive or negative polarity, or uniformly discharging it.

(4) A rotatable back-up roller for press-contacting to the surface of the image bearing member an operating member actable on the image bearing member in the form of a rotatable belt, a traveling web or the like.

In an example of a mechanism for press-contacting a rotatable member to the image bearing member and for rotating it, the roller is supported by opposite end bearings to be movable directly to the image bearing member (or urging the belt, web or the like) to the image bearing member, and the bearings are pushed by a pushing means so as to press-contact directly or indirectly to the image bearing member surface to provide the contact line or area extending along the length of the roller.

A driving gear is integrally mounted directly to a shaft of the roller and is meshed with a driving gear adjacent the driving source mechanism. By this, the driving force is applied to the roller to rotate it at a predetermined peripheral speed. Such a mechanism is generally used.

The reason why the roller is press-contacted to the image bearing member using the pushing means such as spring without completely fixing the shaft of the roller, is that if the shaft is fixed with an elastic roller used as the rotatable member, for example, the width of the nip formed between the image bearing member and the roller considerably changes due to the dimensional errors of the shaft or the roller. If the shaft of the roller is urged by the spring or the like, the nip width does not significantly change even if the precision of the spring setting is deviated.

The above-mentioned transfer roller, the cleaning roller, the contact type charging roller, the back-up roller or the like are required to be press-contacted with substantially uniform pressure along the length of the roller at all times and with stability.

If the press-contact force of the rotatable member to the image bearing member surface is not uniform along the length of the roller, more particularly, between the opposite longitudinal ends of the roller, the non-uniformity of image transfer occurs in the case of the transfer roller, the non-uniform cleaning occurs in the case of the cleaning roller, non-uniform charging (discharging) occurs in the case of the contact type charging roller, a non-uniform press-contact to the belt, web or the like in the case of the back-up roller. This results in deteriorated image quality.

Referring first to FIG. 5, which shows a conventional rotatable member driving mechanism wherein a gear 3 is mounted directly to one longitudinal end of the roller member, and the gear 3 is meshed with a driving gear 4 at the driving source side M to transmit the driving force to the rotatable member 1. In this case, an adverse influence takes place to the uniformity in the pressure distribution along the length of the roller between the roller and the image bearing member. In FIG. 5, the shaft 2*a* of the image bearing member 2 is fixed, and a shaft 9 of the roller 1 is pressed by the pushing means 7 to press the rotatable member 1 to the image bearing member 2.

Therefore, when the driving force is transmitted by the meshing engagement of the gears, the forces are produced to move the gears away from each other (component force in the direction perpendicular to the shaft of the gear), due to the angle of obliquity. Thus, in the case where the rotatable member 1 is provided integrally with a gear 3 for receiving the driving force, and where the gear 3 is meshed with a driving gear 4 to transmit the driving force to the rotatable member 1, the rotatable member 1 directly receives the component force in the direction perpendicular to the shaft of the gear 9 due to the meshing engagement between the driving force receiving gear 3 and the driving gear 4, unless the gears are disposed at particular positions. This results in small or large force influential to the pressure between the rotatable member 1 and the image bearing member 2, in the direction of urging the rotatable member 1 to the image bearing member 2 in addition to the pressing force provided by the pressing means 7 at the driving force receiving end of the rotatable member 1, furthermore in the (opposite) direction of moving the rotatable member 1 away from the image bearing member 2 surface against the urging force by the pressing means 7 (when the gear on the shaft 2*a* of the image bearing member is meshed with the drive receiving gear 3, for example).

Even if an attempt is made to dispose the gears at such positions that the pressure of the rotatable member 1 to the image bearing member 2 is not influenced, but in many cases, it is difficult to dispose them at such positions because of the limitations by usable gears and the rotational speeds thereof.

Accordingly, there is a tendency that the pressure between the rotatable member 1 and the image bearing member 2 is non-uniform along the length of the rotatable member, more particularly, between the opposite longitudinal ends thereof (the pressure is larger at the gear 3 side than the opposite side in the case of FIG. 6 example). Even if a further attempt is made to remove the imbalance in the pressure between the rotatable member and the image bearing member at the opposite longitudinal ends by using different pressing mechanism at the opposite longitudinal ends of the rotatable member or by using different spring constants at the longitudinal ends, it has been practically very difficult to adjust the subtle difference in the pressure.

Even if the pressure between the rotatable member and the image bearing member is made uniform between the opposite longitudinal ends of the rotatable member at the initial setting by adjusting the pressing means such as pressure springs, the influence in the component perpendicular to the gear shaft due to the meshing engagement between the gears becomes significant, because the rotatable member (which is elastic in the case of the transfer roller) does not provide a constant position, because the material property or the configuration thereof changes with repeated use thereof, and because the torque for driving the transfer roller changes due to the influence by the toner particles, paper dust or the like. Thus, even if the pressure is made uniform along the length of the transfer roller at the initial setting, it easily becomes non-uniform sooner or later.

This is not limited to the case of the transfer roller, but similarly applies to the cases of the cleaning roller, contact type charging roller, back-up roller or the like. In addition, this is not limited to the case where the driving means is a gear, but similarly applies to the case where it uses a pulley or a sprocket.

SUMMARY OF THE INVENTION

Accordingly, it is a principal object of the present invention to provide an image forming apparatus wherein when a rotatable member driving means applies a rotationally driving force to the rotatable member, the force influential to the pressure from the rotatable member to the image bearing member is not transmitted to the rotatable member.

It is another object of the present invention to provide an image forming apparatus wherein the distribution of the pressure between the image bearing member and the rotatable member press-contacted thereto is prevented from becoming non-uniform with time of use.

It is a further object of the present invention to provide an image forming apparatus wherein the distribution of the pressure between the image bearing member and the rotatable member is maintained substantially uniform, by which good images can be formed.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
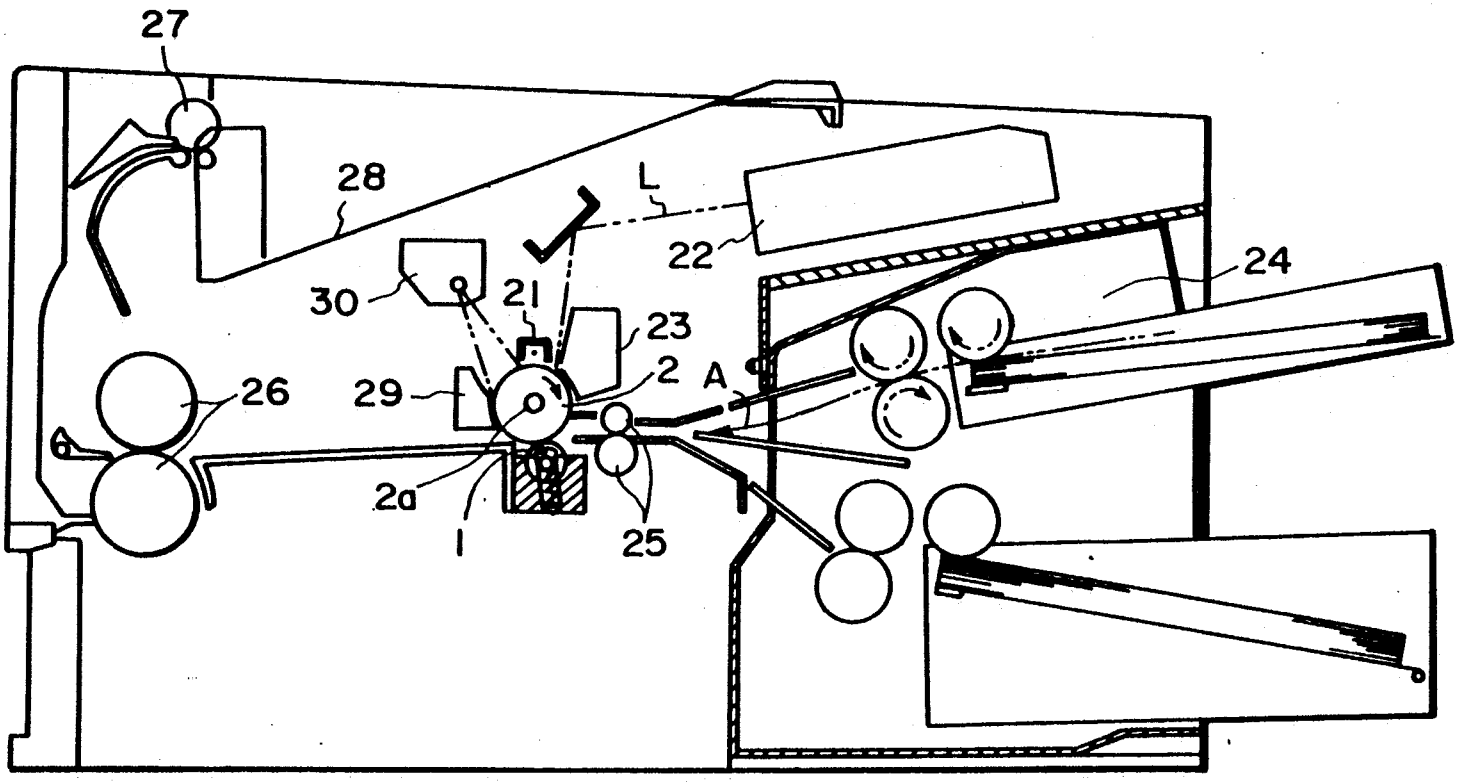
FIG. 1 is a side view of an image forming apparatus according to an embodiment of the present invention.

Referring to FIG. 1, there is shown an image forming apparatus according to an embodiment of the present invention, wherein the rotatable member press-contacted to the image bearing member is shown as being a transfer roller.

Figure 2:
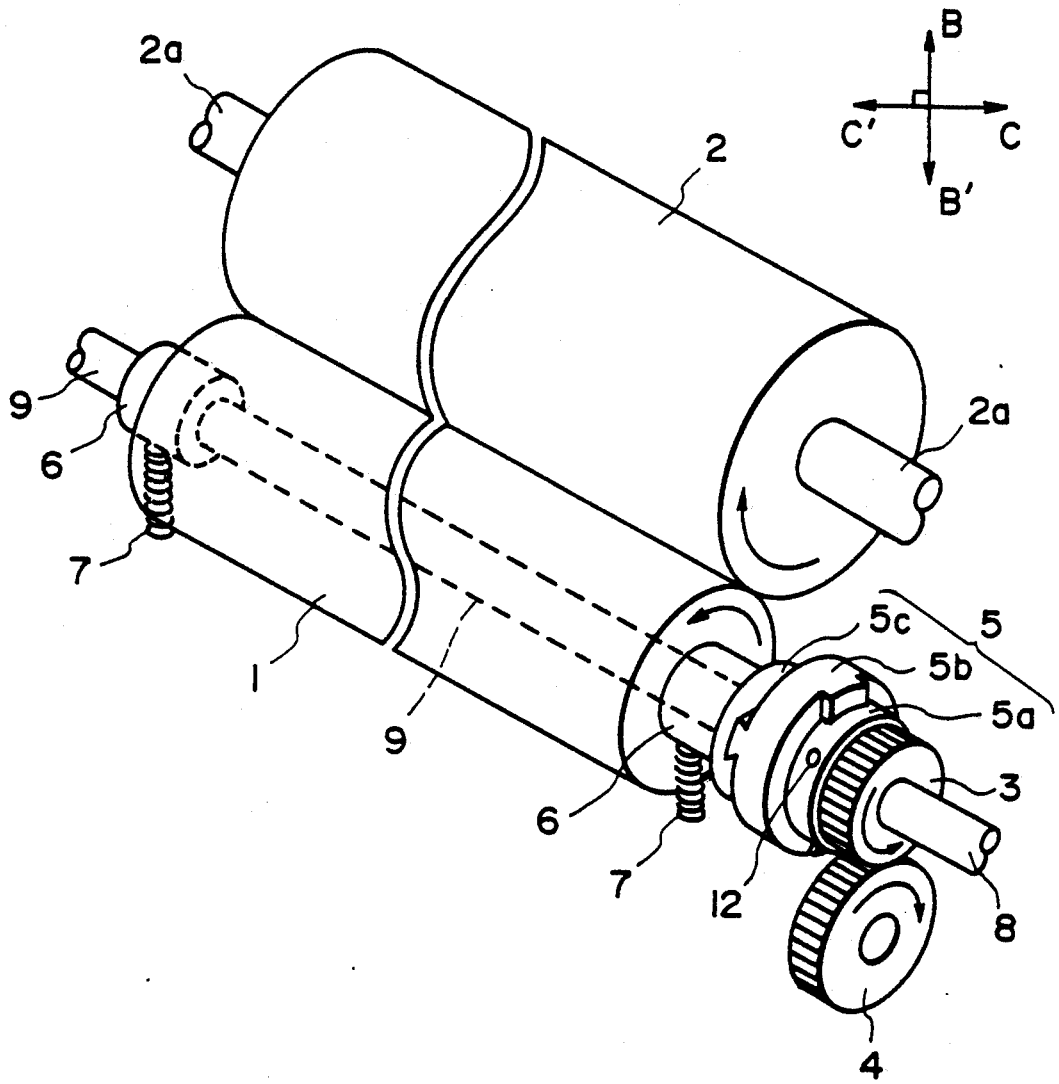
FIG. 2 is a perspective view of the apparatus of FIG. 1 around the transfer roller.

FIG. 2 is a perspective view of a major part of a driving mechanism for the transfer roller.

Figure 3:
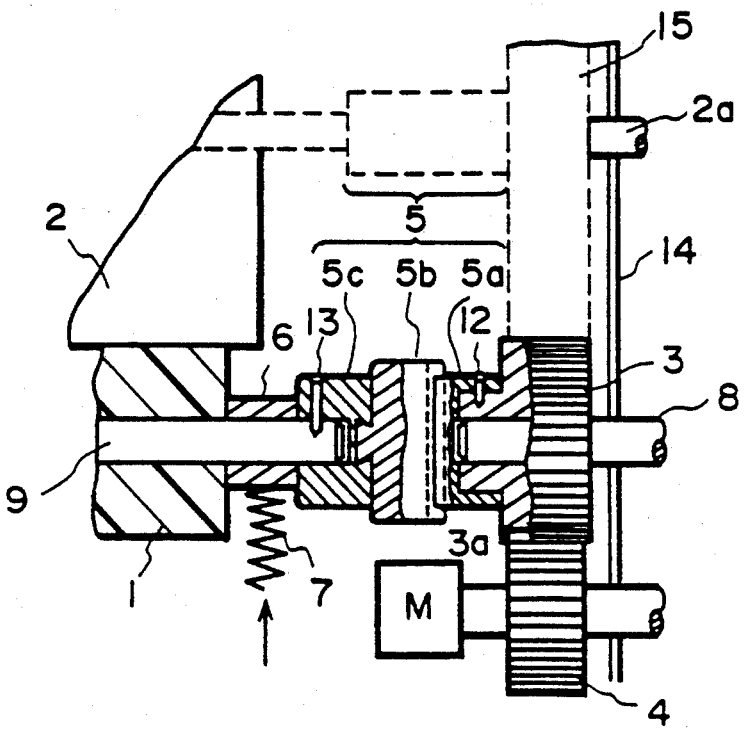
FIGS. 3 and 4 are side views of the coupling portion which is a part of a drive transmission mechanism for an image transfer roller.

FIG. 3 is a side view of a coupling portion as a connecting means.

In FIG. 1, the image forming apparatus comprises an image bearing member 2 in the form of a rotatable drum made of an electrophotographic photosensitive member, an electrostatic recording member or a magnetic recording member or the like, which will hereinafter be called a "drum". The drum 2 is rotationally driven at a predetermined peripheral speed (process speed) in the clockwise direction (indicated by an arrow) about a shaft 2*a*. More particularly, in FIG. 1, the drum 2 is shown as a photosensitive drum. It is uniformly charged by a charging means 21, and is exposed to a laser beam L modulated in accordance with image information, by a laser scanner 22, so that an electrostatic latent image is formed on the drum 2. The latent image is visualized with toner by a developing device 23 into a visible toner image.

An image transfer roller 1 is made of an elastic material such as chloroprene, EPDM (generally a soft rubber material having a rubber hardness of approximately 25 degrees). It is press-contacted to the drum 2 with a predetermined pressure provided by a pressing means, which will be described hereinafter. The image transfer roller is rotationally driven at the same peripheral speed as and in the same peripheral direction as the drum 2 by a driving mechanism which will be described hereinafter. An image transfer position is established as a nip between the rotatable drum 2 and the elastic rubber roller 1. Into the nip a transfer material is fed in the direction indicated by an arrow A in synchronism with the rotation of the drum 2 by a registration roller 25 from sheet feeding station 24 including a cassette, a sheet feeding roller, a sheet feeding guide or the like. The fed transfer material is press-contacted to the surface of the drum 2 by the transfer roller 1, while it is being passed through the nip. During the passage through the nip, the toner image is press-transferred with or without the image transfer bias voltage applied to the transfer roller 1 from the surface of the drum 2. The transfer material having passed through the transfer station is separated from the surface of the drum 2, and is conveyed to an image fixing device 26 where the transferred image is fixed on the transfer material. The transfer material from the fixing device is discharged by discharging rollers 27 to a tray 28. The surface of the drum 2 from which the transfer material has been separated is cleaned by a cleaning device 29, and is exposed to light at its whole surface by post-pre-exposure means 30, so that the residual electric charge is removed, whereby it is prepared for the repeated image formation.

Figure 5:
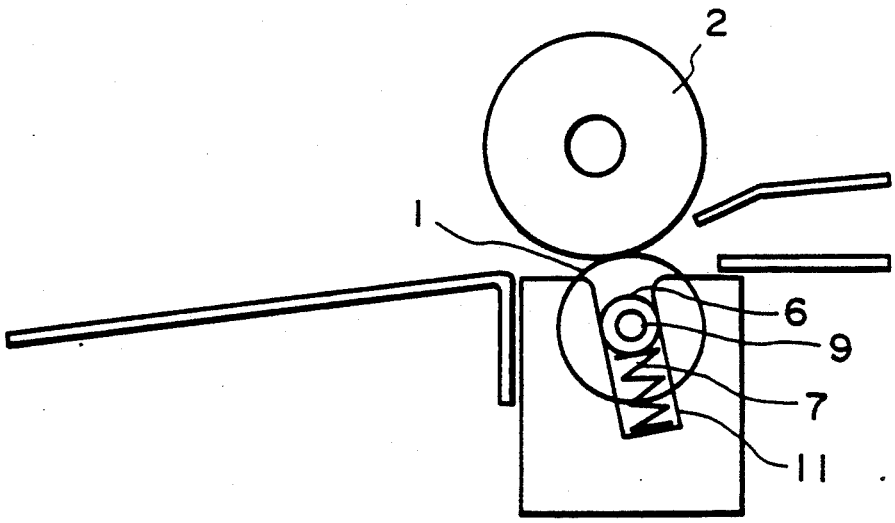
FIG. 5 is an enlarged side view of the apparatus of FIG. 1 around the transfer roller.
Figure 6:
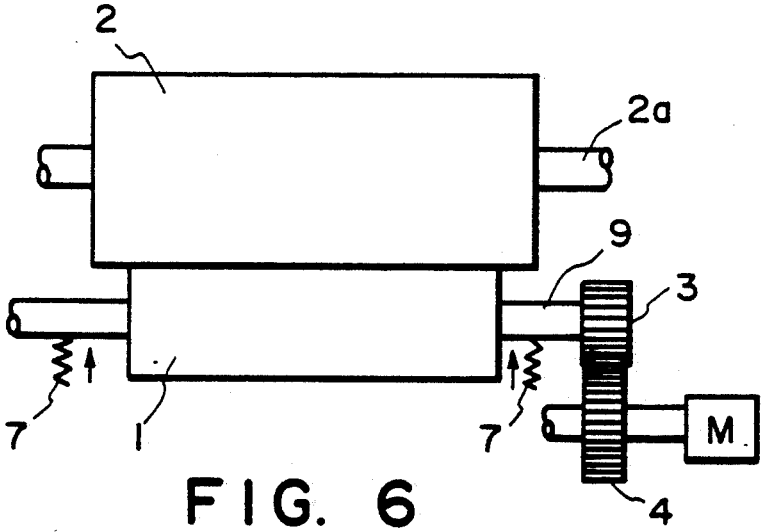
FIG. 6 is a side view illustrating a driving mechanism in a conventional image forming apparatus.

As shown in FIG. 2 and FIG. 5 which is a side view of the FIG. 2 apparatus, the transfer roller 1 has a roller shaft 9 which is rotatably supported by bearings 6 and 6 at the longitudinal opposite ends. As shown in FIG. 3, the bearings 6 and 6 are engaged with guiding grooves 11 formed in side plates 14 of the apparatus toward and away from the drum 2 having the shaft 2*a* fixed to the side plates 14. The transfer roller 1 is thus slidable in the grooves or slots 11 toward and away from the drum 2.

Springs 7 and 7 functioning as the transfer roller pressing means normally press the bearings 6 and 6 along the guiding slot toward the drum 2. The pressing means provided at the longitudinal opposite ends presses the transfer roller 1 to the surface of the drum 2 with a predetermined stabilized pressure along the length of the drum. More particularly, the transfer efficiency in the longitudinal nip between the drum 2 and the transfer roller 1 is made constant, thus providing a uniform image without non-uniform image transfer by the nip having a uniform width along the length of the transfer roller.

A driving force receiving gear 3 functions as a transfer roller driving means connected to one end of the shaft 9 of the transfer roller through an Oldham's coupling 5. The drive receiving gear 3 is disposed upstream of the coupling 9 with respect to the drive transmission direction from the driving source. The drive receiving gear 3, as shown in FIG. 3, is rotatable about a shaft 8 fixedly mounted to a predetermined position on the side plate 14 of the apparatus.

The Oldham's coupling 5 has a first member 5*a* having a dovetail groove and a second member 5*b* having a projection in sliding engagement with the dovetail groove for relative sliding movement along a direction perpendicular to the axis of the coupling 5, and a third member 5*c* having a dovetail groove in slidable engagement with a projection of the second member 5*b* on the opposite side from the above-mentioned projection for relative sliding movement perpendicular to the direction of the slidable movement between the first member 5*a* and the second member 5*b*. Shown in FIG. 2, a projection of the second member 5*b* extending in the direction BB′ and the groove of the first member 5*a* having a width slightly larger than the width of the projection are engaged; and the projection of the second member 5*b* extending in the direction CC′ perpendicular to the direction BB′ and the groove of the third member 5*c* having a width slightly larger than the width of the projection are engaged. The first member 5*a* is fixedly mounted to the gear 3 by screws, more particularly to a boss 3*a* of the drive receiving gear 3; and the third member 5*c* is fixedly mounted on a shaft 9 by screws 13, so that the gear 3 and the shaft 9 are connected through the Oldham's coupling 5.

A driving gear 4 is disposed at the driving source side, the driving source including a motor M, and it is in meshing engagement with a drive receiving gear 3 at the transfer roller side.

The driving force of the driving gear 4 is transmitted to the transfer roller 1 through the drive receiving gear 3, the Oldham's coupling 5 and the transfer roller shaft 9, by which the transfer roller 1 is rotated in the counterclockwise direction at the same peripheral speed as and in the same peripheral direction as the drum 2. The shaft of the driving gear 4, the shaft 8 of the drive receiving roller 8 and the shaft 2*a* of the drum 2 are all mounted fixedly on the side plates 14. However, as in the case where only the drum 2 is in a process cartridge which is detachably mountable to the main assembly of the image forming apparatus, only the shaft 2*a* of the drum 2 may be fixed on the cartridge which is fixed in the main assembly when in use.

During the rotation of the driving gear 4 and the drive receiving gear 3 while they are in meshing engagement, the gears 4 and 3 receive the forces having components in the direction away from each other and in the direction perpendicular to the shaft of the gear. The component force applied to the drive receiving gear 3 which is at the transfer roller 1 side is absorbed by the Oldham's coupling 5, and therefore, it is not transmitted to the transfer roller shaft 9, and therefore, not to the transfer roller 1. As shown in FIG. 2, the Oldham's coupling 5 transmits the rotational driving force from the gear 3 coaxially with the rotational shaft 9. Therefore, the deformation which otherwise results from the force component is absorbed by the second member 5*b* functioning as the deformation absorbing portion. The transfer roller 1 is not influenced by the component force resulting during the rotations of the gears 4 and 3.

Thus, the state of press-contact between the transfer roller 1 and the drum 2 can be determined only by the pressing forces of the pressing means 7 and 7 acting on the shaft at the opposite longitudinal end portions of the transfer roller 1. More particularly, by using the same pressing means at the opposite ends, the transfer roller 1 can be stably press-contacted to the surface of the drum 2 with a predetermined pressure uniformly distributed between the opposite ends. Therefore, the image transfer efficiency at the nip between the drum 2 and the transfer roller 1 is made uniform along the length of the transfer position, and therefore, the width of the nip required for providing a uniform image without a non-uniform image transfer can be uniform along the length of the transfer position. In addition, since the transfer material can be advanced while the image is being transferred onto the transfer material, and therefore, the transfer material is not obliquely advanced, so that the possibility of a jam can be minimized.

In addition, it is easy to finely adjust the pressures between the opposite ends of the transfer roller 1. Since the pressing means 7 and 7 at the opposite ends may have the same structure, the cost can be reduced with the minimum possibility of error in the assembling.

Since the pressing means 7 and 7 at the opposite ends has the same structure and the same pressing conditions, the uniform pressure distribution along the length of the transfer roller can be stably maintained even if the load for rotationally driving the transfer roller 1 changes, or even if the eccentricity occurs in the center of the transfer roller 1. In addition, since the drive receiving gear 3 is connected with the transfer roller 9 through the Oldham's coupling 5, the driving force from the driving gear 4 can be transmitted to the shaft 9, and therefore, to the transfer roller 1 without change of the angular velocity, even if there occurs a deviation between the centers (axes) of the transfer roller shaft 9 and the gear 3 shaft 8. By this, the transfer roller 1 and the drum 2 are always rotated at constant speeds, so that the possibility of image deviation due to slippage between the drum 2 and the transfer material passing through the transfer position can be prevented.

When the transfer roller 1 is assembled into or disassembled from the apparatus, the coupling between the transfer roller shaft 9 and the third member 5*c* of the Oldham's coupling 5 is released, or by releasing the coupling between the drum receiving gear 3 and the first member 1*a* of the Oldham's coupling 5, so that it is not necessary to dismount the drive receiving gear 3 fixed on the side plate of the main assembly. Therefore, the gear train constituted by the gear 3 and the gear 4 meshed therewith can be maintained covered by a protection cover. Since all the gears can be fixed, the accuracy in the meshing engagement is improved.

Figure 4:
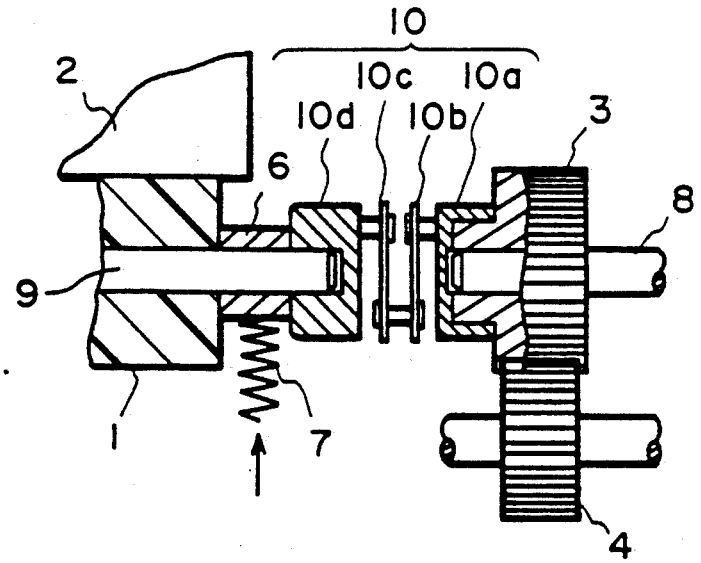

FIG. 4 shows another embodiment wherein in place of the Oldham's coupling 5, a disk spring coupling 10 is used. In place of the second member 5*b* of the Oldham's coupling, pins 10*b* are connected to a first member 10*a* and a third member 10*d*, respectively. The pins 10*b* are connected to disks 10*c*, respectively. The disks 10*c* are further connected by a pin 10*b*. The component force (deformation) applied to the drive receiving gear 3 in the direction toward and away from the drum 2 is absorbed by the pins 10*b* and the disks 10*c* which constitute a deformation absorbing portion of the coupling 10. Where the Oldham's coupling 5 is used, the toner particles or the paper dust may enter the sliding portions thereof, depending on the structure of the mechanism, with the result of increased sliding load, and therefore, the smooth rotation is obstructed. The flexible disk spring type coupling 10 has the advantage that the performance thereof is not decreased even if the toner particles or the paper dust are deposited thereto.

The usable couplings are, for example, a diaphragm type flexible coupling, a coil flexible coupling using a coil spring in place of the pins in FIG. 4, a flexible twisted groove type coupling or the like. The drive receiving gear may be in the form of a pulley or a sprocket.

In the foregoing embodiments, the coupling is disposed at the drive transmission side of the transfer roller. However, the coupling may be disposed at the drive transmission side of the drum 2, as shown in FIG. 3 by broken lines. More particularly, the driving force from the gear 3 is transmitted to a gear 15, and to a drum shaft 2*a* through a coupling. As will be understood, the coupling may be disposed at least on one of the drive transmission side in the transmission path between the driving source to the transfer roller and the drive transmission side in the drive transmission path from the driving source to the drum 2.

In the foregoing embodiment, an image transfer roller is taken, but the drive transmission mechanism may be usable with a cleaning roller, a contact charging roller or the like with the similar advantageous effects.

Figure 7:
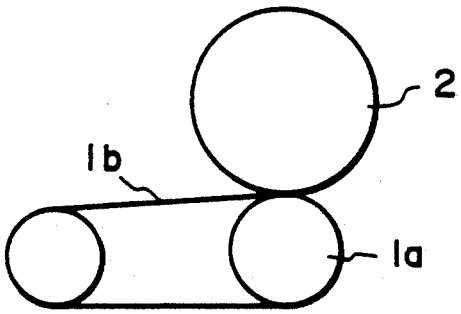
FIG. 7 is a partial side view of an image forming apparatus according to another embodiment of the present invention.

As described in the foregoing, the present invention is applicable to drive the case (FIG. 7) where a roller 1*a* causes a belt 1*b* to the image bearing member 2.

As described in the foregoing, according to the present invention, the rotational driving force for the rotatable member is transmitted from a longitudinally aligned connecting means from the driving means, and the driving force from the driving source is transmitted coaxially with the shaft of the rotatable member. Therefore, it is different from a conventional mechanism using gears wherein the driving force is transmitted in a direction perpendicular to the axis without coaxial coupling. Therefore, according to the present invention, the force which may be influential to the state of pressure between the rotatable member and the image bearing member is absorbed or eased by the coupling means, so that only the rotational force is transmitted to the rotatable member.

Therefore, (1) The state of press-contact between the rotatable member and the image bearing member can be determined substantially only by the pressing force of the pressing means applied to each of the longitudinal ends of the rotatable member. The pressing means may be of the same structure, and/or have the same pressing force. The pressure therebetween can be easily and assuredly made uniform between the opposite longitudinal ends. The uniform state can be maintained stable at all times. The fine adjustment of the pressure between the longitudinal ends can be easily performed.

(2) Since the pressing means at the opposite longitudinal ends of the rotatable member may have the same structure and the same parts, so that the cost thereof can be reduced, and the possibility of erroneous assembling is reduced.

(3) It is possible to use the same pressing means at the longitudinal opposite ends of the rotatable member, so that the pressing action may be the same at the opposite ends, and therefore, even if the load for rotating the rotatable member varies or even if the center of the roller which may be elastic as in the image transfer roller varies, the rotatable member may be stably press-contacted to the image bearing member with uniform pressure along the length of the image bearing member.

(4) The connecting means can transmit the driving force of the driving means to the rotatable member substantially without the change of angular velocity even when the center of the shaft of the rotatable member and the center of the driving means are deviated. Therefore, the peripheral speed of the rotatable member can be maintained constant at a predetermined level.

(5) When the rotatable member is mounted into or dismounted from the apparatus, the driving means connected to the rotatable member through the coupling means may be taken out by separating the rotatable member from the coupling means or by separating the coupling means from the driving means, without the necessity of removing the entirety of the mechanism. Therefore, the driving means portion can be covered by a covering member. In this case, the operator is protected from inadvertent touching to the driving means. In addition, deposition of foreign matter to the driving means, contamination of the driving means, introduction of foreign matter thereinto can be prevented.

(6) All the members at the driving side can be fixed, and therefore, the coupling accuracy such as meshing engagement accuracy between the transmission members can be increased.

As described in the foregoing, according to the present invention, the press-contact state between the image bearing member and a rotatable member can be stably made uniform along the length of the rotatable member.

In addition, the state of press-contact is uniform along the length of the image bearing member, and therefore, the resultant image is uniform.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

a rotatable member press-contacted to said image bearing member in relation to an image forming process for forming an image on said image bearing member, said rotatable member having a longitudinal shaft;

driving means for driving said rotatable member; and transmission means for transmitting a driving force to the shaft of said rotatable member from said driving means, said transmission means having coupling means for transmitting a rotational force substantially without imparting to said shaft a force in a radial direction thereof.

2. An apparatus according to claim 1, wherein said rotatable member comprises elastic material.

3. An apparatus according to claim 1 or 2, wherein said rotatable member is supported for movement toward and away from said image bearing member.

4. An apparatus according to claim 3, further comprising guiding means for guiding said rotatable member toward and away from said image bearing member.

5. An apparatus according to claim 3, further comprising pressing means for press-contacting said rotatable member to said image bearing member.

6. An apparatus according to claim 5, wherein said pressing means is a spring.

7. An apparatus according to claim 3, wherein said coupling means transmits the rotational force substantially without transmitting a force in a direction of the movement toward and way from said image bearing member.

8. An apparatus according to claim 1, wherein said transmission means includes a gear for transmitting the driving force from said driving means to an upstream side of said coupling means with respect to a drive transmission direction.

9. An apparatus according to claim 1, further comprising a supporting member for fixedly supporting a shaft of said image bearing member.

10. An apparatus according to claim 1, wherein said coupling includes a projection and a groove for slidable engagement with the projection for transmitting the driving force from said driving means.

11. An apparatus according to claim 1, wherein said rotatable member is an image transfer rotatable member for transferring an image formed on said image bearing member to a transfer material.

12. An apparatus according to claim 1, wherein said rotatable member is a charging rotatable member for electrically charging said image bearing member.

13. An apparatus according to claim 1, wherein said rotatable member is a cleaning roller for removing residual matter from said image bearing member.

14. An apparatus according to claim 1, wherein said rotatable member includes a belt for press-contact to said image bearing member and a roller for urging the belt to said image bearing member.

15. An apparatus according to claim 1, wherein said coupling means includes an absorbing portion for absorbing deformation toward and away from said image bearing member, transmitted from an upstream side of said coupling means in a direction of a drive transmission.

16. An apparatus according to claim 1, 9, or 15, wherein said coupling means is slidable in the radial direction.

17. An apparatus according to claim 1, wherein said transmission means has a drive transmission member for transmitting the driving force to said shaft substantially without changing an angular speed of said drive transmission member despite movement of said shaft relative to said transmission means.

18. An image forming apparatus, comprising:

a movable image bearing member;

a rotatable member press-contacted to said image bearing member in relation to an image formation process for forming an image on said image bearing member, said rotatable member having a longitudinal shaft, said image bearing member being rotatably supported;

driving means for driving said rotatable member;

drive transmission means for transmitting driving force from said driving means coaxially with said shaft of said rotatable member, said drive transmission means having a drive transmission member rotatably supported on a shaft for transmitting the driving force to said shaft of said press-contacted rotatable member, and the drive transmitting force being transmitted to said shaft of said press-contacted rotatable member substantially without changing an angular speed of said drive transmission member despite movement of said shaft of said press-contacted rotatable member relative to said shaft of said drive transmission member.

19. An apparatus according to claim 18, wherein said rotatable member comprises elastic material.

20. An apparatus according to claim 18 or 19, wherein said rotatable member is supported for movement toward and away from said image bearing member.

21. An apparatus according to claim 20, further comprising guiding means for guiding said rotatable member toward and away from said image bearing member.

22. An apparatus according to claim 20, further comprising pressing means for press-contacting said rotatable member to said image bearing member.

23. An apparatus according to claim 22, wherein said pressing means is a spring.

24. An apparatus according to claim 5 or 22, wherein said pressing means has first and second urging members having the same configuration, at opposite longitudinal ends of said shaft of said rotatable member.

25. An apparatus according to claim 20, wherein said drive transmission means transmits the driving force substantially without transmitting a force in a direction of the movement toward and away from said image bearing member.

26. An apparatus according to claim 18, wherein said transmission means includes a gear for transmitting the driving force from said driving means to an upstream side of said drive transmission member with respect to a drive transmission direction.

27. An apparatus according to claim 18, further comprising a supporting member for fixedly supporting a shaft of said image bearing member.

28. An apparatus according to claim 18, wherein said drive transmission member includes a projection and a groove for slidable engagement with the projection for transmitting the driving force from said driving means.

29. An apparatus according to claim 18, wherein said rotatable member is an image transfer rotatable member for transferring an image formed on said image bearing member to a transfer material.

30. An apparatus according to claim 18, wherein aid rotatable member is a charging rotatable member for electrically charging said image bearing member.

31. An apparatus according to claim 18, wherein said rotatable member is a cleaning roller for removing residual matter from said image bearing member.

32. An apparatus according to claim 18, wherein said rotatable member includes a belt for press-contact to said image bearing member and a roller for urging the belt to said image bearing member.

33. An apparatus according to claim 18, wherein said drive transmission member includes an absorbing portion for absorbing deformation toward and away from said image bearing member, transmitted from an upstream side of said drive transmission member in a direction of a drive transmission.

34. An apparatus according to claim 18 or 19, further comprising a supporting member for securely supporting said shaft of said drive transmission member.

35. An apparatus according to claim 34, wherein said shaft of said drive transmission member receives force in a direction crossing with an axial direction of said shaft of said drive transmission member, at a side thereof upstream with respect to said drive transmitting direction thereof.

36. An apparatus according to claim 18, wherein said shaft of the drive transmission member and said shaft of said press-contacted rotatable member are overlaid.

37. An image forming apparatus, comprising:

an image bearing member rotatable about an axis;

a rotatable member press-contacted to said image bearing member in relation to an image forming process for forming an image on said image bearing member, said rotatable member having a longitudinal shaft;

driving means for driving said image bearing member; and transmission means for transmitting a driving force from said driving means to said image bearing member, said transmission means including coupling means for transmitting a rotational force substantially without imparting to said shaft a force in a radial direction thereof.

38. An apparatus according to claim 37, wherein said transmission means has a drive transmission member rotatably supported on a shaft for transmitting the driving force to said shaft substantially without changing an angular speed of the drive transmission means despite movement of said shaft relative to said transmission means.

39. An apparatus according to claim 38, wherein said press-contacted rotatable member comprises a longitudinal shaft and wherein said shaft of the drive transmission member and said shaft of said press-contacted rotatable member are overlaid.

40. An apparatus according to claim 38, further comprising a supporting member for securely supporting a shaft of said drive transmission member.

41. An apparatus according to claim 40, wherein the shaft of said drive transmission member receives force in a direction crossing with an axial direction of said shaft of said drive transmission member, at a side thereof upstream with respect to said drive transmitting direction thereof.

42. An apparatus according to claim 29, wherein said rotatable member is an image transfer rotatable member for transferring an image formed on said image bearing member to a transfer material.

43. An apparatus according to claim 37 or 39, wherein said image bearing member is supported for movement toward and away from said rotatable member.

44. An apparatus according to claim 29, wherein said rotatable member comprises elastic material.

* * * * *

UNITED STATES PATENT AND TRADEMARK OFFICE

CERTIFICATE OF CORRECTION

PATENT NO. : 5,070,366

DATED : December 3, 1991

INVENTOR(S) : Yoshiro Tsuchiya

It is certified that error appears in the above-identified patent and that said Letters Patent is hereby corrected as shown below:

COLUMN 1:

Line 24, "direction" should read --speed--.
Line 41, "to" should read --for--.

COLUMN 5:

Line 32, "coupling 9" should read --coupling 5--.

COLUMN 6:

Line 4, "roller 8" should read --gear 3--.

COLUMN 7:

Line 8, "first member 1a" should read --first member 5a--.
Line 58, "to the" should read --to rotate the--.

COLUMN 9:

Line 32, "way" should read --away--.
Line 43, "coupling" should read --coupling means--.
Line 66, "Claim 1, 9, or 15," should read --Claim 1, 10, or 15,--.

UNITED STATES PATENT AND TRADEMARK OFFICE

CERTIFICATE OF CORRECTION

PATENT NO. : 5,070,366 Page 2 of 2

DATED : December 3, 1991

INVENTOR(S) : Yoshiro Tsuchiya

It is certified that error appears in the above-identified patent and that said Letters Patent is hereby corrected as shown below:

COLUMN 10:

Line 56, "member" should read --means--.

COLUMN 11:

Line 1, "aid" should read --said--.
Line 17, "claim 18 or 19," should read --claim 17 or 18,--.

COLUMN 12:

Line 28, "claim 29," should read --claim 37,--.
Line 36, "claim 29," should read --claim 37,--.

Signed and Sealed this

Fourth Day of May, 1993

Attest:

Michael K. Kirk

MICHAEL K. KIRK

Attesting Officer

Acting Commissioner of Patents and Trademarks